United States Patent [19]

McNally

[11] 4,180,001

[45] Dec. 25, 1979

[54] CENTER FILLER FOR RAILWAY VEHICLE

[75] Inventor: George S. McNally, South Holland, Ill.

[73] Assignee: Pullman Incorporated, Chicago, Ill.

[21] Appl. No.: 863,385

[22] Filed: Dec. 22, 1977

[51] Int. Cl.[2] ..... B61F 1/08; B61F 5/16

[52] U.S. Cl. ..... 105/420; 213/57

[58] Field of Search ..... 105/199 C, 228, 420; 213/57; 308/137

[56] References Cited

U.S. PATENT DOCUMENTS

| | | | |
|---|---|---|---|
| 1,243,387 | 10/1917 | Coleman | 308/137 |
| 1,725,042 | 8/1929 | Zimmer | 105/402 |
| 2,122,159 | 6/1938 | Shaver | 105/228 |
| 2,184,337 | 12/1939 | Duryea | 105/228 |
| 3,670,662 | 6/1972 | Fillion | 105/199 C |
| 3,703,239 | 11/1972 | Furniss | 213/57 |

*Primary Examiner*—Trygve M. Blix

*Assistant Examiner*—Frank Atwood

*Attorney, Agent, or Firm*—Richard J. Myers

[57] ABSTRACT

A modular rear draft lug and center filler construction for railway vehicles comprising a pair of rear draft lugs which extend from the draft sill area along each side of the inside of the center sill and continue through the center filler area to rear draft lug stops. A number of slotted plates are fitted over portions of the draft lugs and attached to a bottom cover plate which nests into the center sill. A center plate has a mounting skirt with upwardly extending flanges to abut each end of the bottom cover plate to resist longitudinal impact forces. The rear draft lugs are mechanically attached to the center sill and the center filler plates, center plate and rear draft lug stops may be easily installed after the rear draft lugs are attached. The riveted construction provides for even force distribution and alignment and ease of replacement should damage or failure occur.

6 Claims, 7 Drawing Figures

FIG. 1
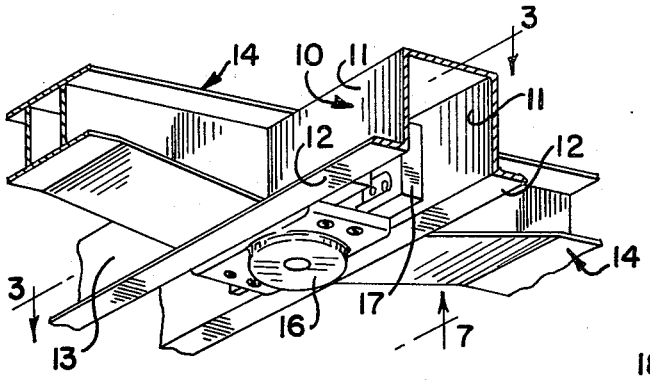
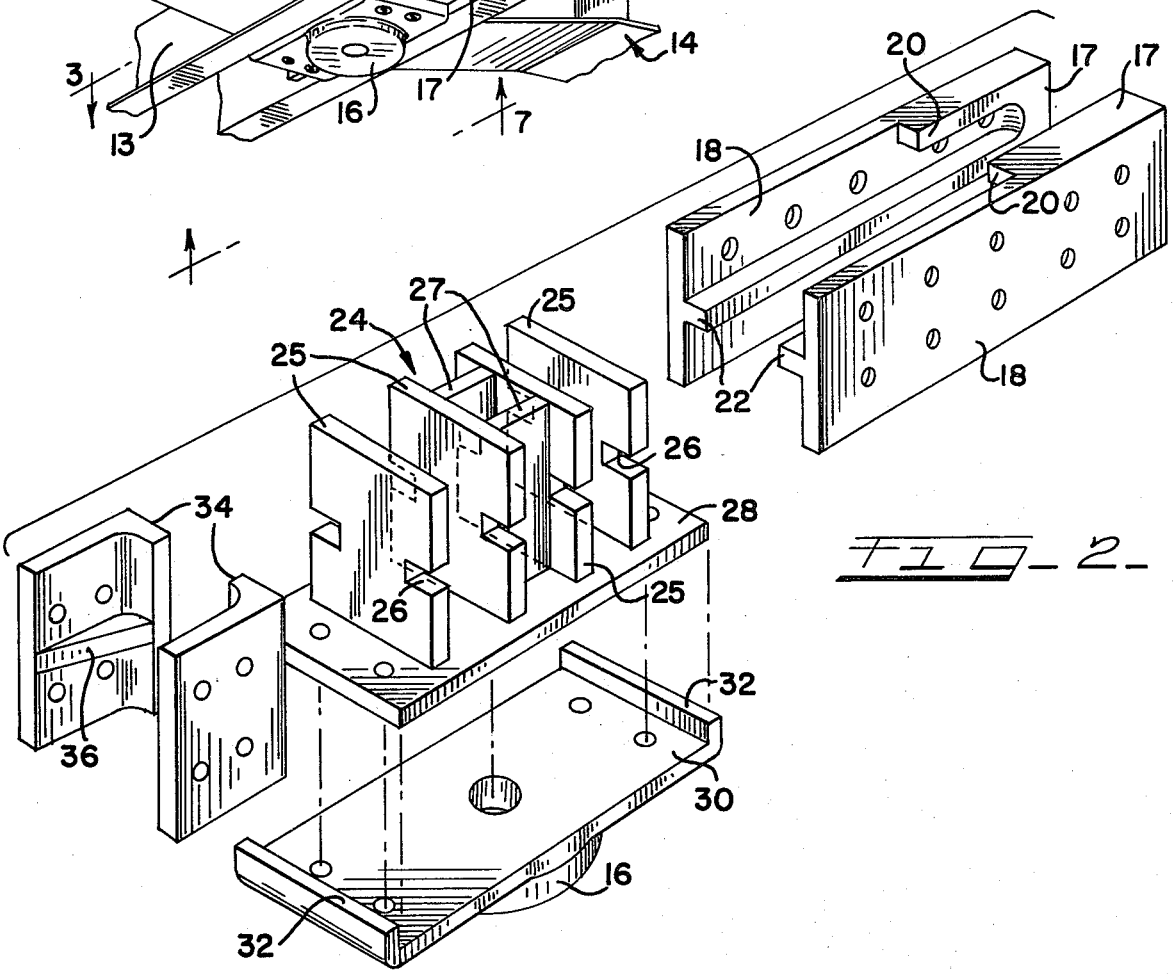
FIG. 2
FIG. 3
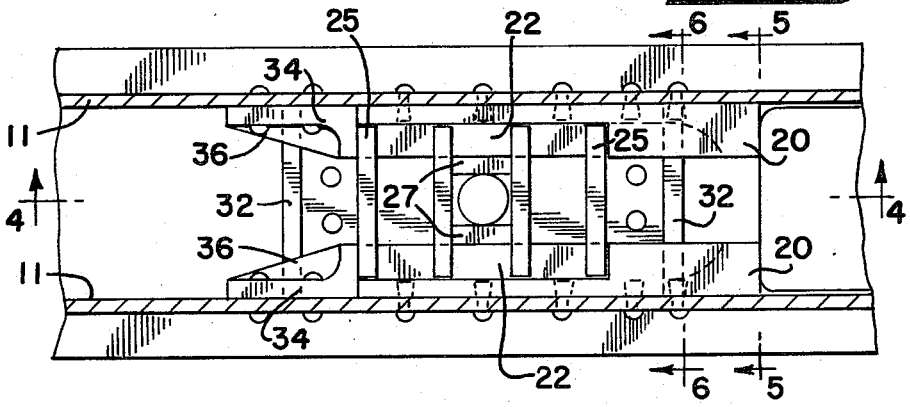

FIG. 4
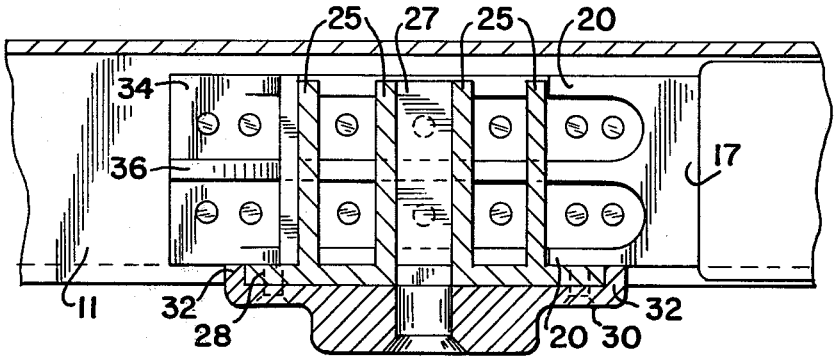
FIG. 5
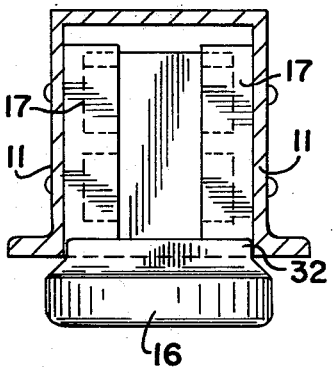
FIG. 6
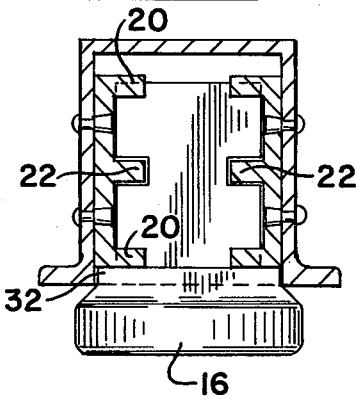
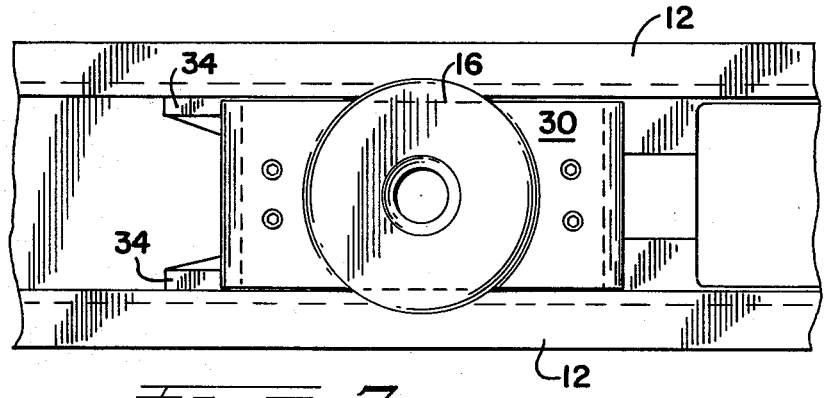
FIG. 7

CENTER FILLER FOR RAILWAY VEHICLE

BACKGROUND OF THE INVENTION (1) Field of the Invention

This invention pertains to railway vehicles and in particular to the underframe or draft sill area where laterally extending bolsters are connected with a longitudinally extending center sill and a rigidifying structure known as the center filler is used to strengthen and evenly distribute forces in this area.

(2) Description of the Prior Art

The prior art center filler reinforcement arrangements generally provide a rear draft lug and a number of welded, horizontally extending reinforcing ribs extending rearwardly therefrom to the center filler. A typical construction is shown in the Shaver, U.S. Pat. No. 2,122,159 (1938). However, this construction is sometimes not advisable with the so-called short overhang railroad cars in which there is a shortened dimension between the rear draft lug and the center filler. With the short overhang cars there is a requirement for heavy reinforcing ribs extending between the rear draft lug and the center filler area to adequately absorb the buff forces encountered during car operations. However, only the most discreet use of heavy reinforcing ribs welded to the draft sill is advisable because of the possibility of creating stress concentrations and not adequately and evenly distributing the buff forces throughout the center filler area and into the center sill. Further, in the event failure occurs or wear to any of the components becomes excessive, it is difficult and oftentimes expensive and time consuming to repair a welded construction.

This disclosure provides a modular rear draft lug and center filler arrangement that may be easily added to a so-called short overhang railway vehicle to adequately distribute buff forces and provide a rigid, easily replaced, center filler construction.

SUMMARY OF THE INVENTION

This invention pertains to an improved rear draft lug and center filler arrangement for railway vehicles. The design disclosed herein provides draft lugs having a plate type construction and of sufficient length to extend alongside the center sill through the center filler area. These rear draft lugs have suitable positioned openings to receive high strength bolts or rivets for attachment to the webs of the draft sill portion of the center sill. Subsequent to installation of the lugs, a number of transversely extending center filler plates and a center filler bottom cover plate are positioned within the rear draft lugs and fitted in such a manner as to resist transverse bolster forces that bear upon the center filler area. These vertical plates are positioned on a bottom cover plate and rigidly attached thereto by welding or may be cast integrally therewith. Next, the skirt portion of the center plate is fitted about the bottom cover plate and securely attached. Finally, a pair of rear draft lug stops are attached to the center sill adjacent the ends of the rear draft lugs to provide further reinforcement and distribution of longitudinal forces received and transmitted by the rear draft lugs.

The center plate skirt includes front and rear flanges that fit about the bottom cover plate in such a manner as to provide longitudinal restraint to the center plate.

It is therefore an object of the present invention to provide modular rear draft lug and center filler assembly that may be easily installed in a railway vehicle to efficiently distribute buff forces through the center sill and provide a rigid structure to resist forces transmitted by the body bolsters.

It is another object of this invention to provide a unitized center filler assembly wherein a center plate is provided with an attaching skirt with front and rear flanges that fit about the bottom cover plate of the center filler to provide increased resistance to movement of the center plate.

These and other objects of the invention will become apparent to those having ordinary skill in the art with reference to the following description, drawings and appended claims.

BRIEF DESCRIPTION OF THE DRAWINGS

FIG. 1 is a pictorial illustration of a draft sill, center sill, bolster and center filler area of a railway vehicle;

FIG. 2 is an exploded perspective view of the center filler assembly;

FIG. 3 is a sectional view taken along lines 3—3 of FIG. 1;

FIG. 4 is a sectional view taken generally along lines 4—4 of FIG. 3;

FIG. 5 is a sectional view taken along lines 5—5 of FIG. 3;

FIG. 6 is another sectional view taken generally along lines 6—6 of FIG. 3; and FIG. 7 is a view taken along lines 7—7 of FIG. 1.

DETAILED DESCRIPTION

Referring now to the drawings, and in particular to FIG. 1, there is shown a portion of a railway car underframe including a draft sill 10 which provides a housing for a coupler yoke and an associated shock absorbing unit (not shown). Draft sill 10 includes vertically extending side webs 11 and laterally or horizontally extending lower flanges 12. The draft sill 10 forms a portion of a continuous center sill 13 that extends from one end of the railway vehicle to the other. A pair of so-called bolster beams 14 extend laterally and outwardly from the center sill 13 in an area where a center plate 16 is located. Center plate 16 provides one portion of a connection that is made between the supporting trucks (not shown) and the car body.

As shown in FIGS. 1 and 2, a pair of so-called draft lugs 17 are located toward the rear of draft sill 10. Draft lugs 17 receive impacts from the car cushioning device and transfer these so-called buff forces from the coupler and the cushioning device into the car body. As shown in FIG. 2, the draft lugs 17 have a lug extension 18 which extends through the center filler area. Draft lugs 17 also include short top and bottom reinforcing ribs 20 and an intermediate rib 22 which extends continuously along the length of the side lug extension 18 and forms connection means.

As shown in FIGS. 2, 3 and 4, a center filler 24 is provided to form a rigid connection between the car bolster 14 and the center sill 13 and to distribute center plate forces. The area where the bolsters 14 are connected to the center sill 13 is an area that receives extremely high forces during movement of the railroad car and must be properly reinforced in order that premature failure does not occur. Thus, a number of plates 25 having slots 26 are provided and provide a connection with the ribs 22. Of the four plates, the two intermediate plates are separated and held in place by divider 27. The dividers 27 operate in conjunction with the associated center filler plates 25 to provide a reinforced opening into which a center pin may be inserted.

Center filler plates 25 may be rigidly welded to a bottom cover plate 28 or, as shown in FIG. 4, may be manufactured as an integral, cast unit with bottom cover plate 28.

It is contemplated in constructing and adapting this rear draft lug-center filler arrangement to a railway car, draft lugs 17 are first bolted or riveted to the side webs 11 of the center sill 13. If the lugs 17 are attached with high strength bolts or rivets it is imperative that the bolt heads or rivet heads be flush with the inside surface of the draft lug extension 18 in order that the plates 25 of center filler 24, as shown in FIG. 2, may be easily slid along the continuous rib 22 until the first center filler plate 25 contacts the top and bottom ribs 20. After the center filler 24 is positioned, center plate 16 and its associated center plate skirt 30 and upwardly extending flanges 32 are nested about the bottom cover plate 28 and then bolted or otherwise securely attached thereto. When so attached, flanges 32 come in contact with the bottom cover plate 28 to assist in holding the center plate 16 securely in position when buff and draft forces are encountered.

After center plate 16 is positioned, draft lugs stops 34 are positioned against the innermost center filler plate 25 and then riveted or bolted to the center sill web 11. Lug stops include reinforcing gusset ribs 36.

Thus, it can be seen from the drawings, and in particular FIG. 4, that when buff forces are applied to the face of draft lug 17 these longitudinal forces will be evenly distributed into the center sill side webs 11. Because of the length of contact between the side webs 11 and the draft lug extension 18 of the draft lugs 17, longitudinal forces have a large area for distribution thus reducing stresses. Further buff forces are transferred from the draft lug extensions 18 and the continuous rib 22 into the draft lug stops 34 that are placed on the center sill side of the center filler 24.

In the event it is desirable to replace the center filler unit the reverse procedure is followed. That is, the draft lug stops 34 are first removed followed by removal of the center plate 16. After the center plate 16 is removed the center filler 24 may be then slid away from the draft sill 10 until it is removed from any engagement with the draft lug extensions 18 and its associated continuous ribs 22. When the center filler 24 is removed the draft lugs may then be inspected or removed as required.

It is noticed that the center plate 16 and its attached skirt 30 are attached to the bottom cover plate 28. Thus, problems associated with misalignment of the center sill flanges and center filler bottom cover plate 24 when the center plate 16 is attached, cause stress concentrations and failures. Here, because center plate 16 is not attached directly to any portion of the center sill 13, misalignment problems are reduced.

The foregoing description and drawings merely explain and illustrate the invention and the invention is not limited thereto, except insofar as the appended claims are so limited, as those who are skilled in the art and have the disclosure before them will be able to make modifications and variations therein without departing from the scope of the invention.

What is claimed is:

1. In a railway vehicle having an underframe with a draft sill with spaced side webs and spaced flanges with bottom surfaces located on a horizontal plane and said draft sill forming a connection with car body bolsters, the improvement comprising a modular rear draft lug and center filler arrangement including:
   - draft lug means having extension means adjacent to the side webs and being continuous through the connection between the body bolsters and the draft sill;
   - connection means on said draft lug means;
   - means attaching the draft lug means to said side webs;
   - center filler means with vertically disposed plate means abutting the draft lug means;
   - said center filler means having means securing said center filler means with said connection means;
   - said center filler means having a bottom cover plate;
   - said bottom cover plate having a lower surface disposed in the same horizontal plane with the spaced flanges of the draft sill;
   - center plate means;
   - said center plate means having a skirt portion with upwardly extending flange means;
   - said flange means being spaced apart a first distance to nestle about the bottom cover plate; and
   - means attaching said skirt portion to said bottom cover plate.

2. The invention according to claim 1, and;
   - rear lug stops with reinforcing means adjacent the extension means of the draft lug means.

3. The arrangement of claim 1, wherein said draft lug means include:
   - shortened reinforcing ribs;
   - said shortened reinforcing ribs having ends abutting said plate means of the center filler means;
   - said shortened reinforcing ribs having means overlapping said bottom cover plate.

4. The rear draft lug and center filler arrangement of claim 1, and:
   - said connection means comprises continuous reinforcing rib means;
   - said means securing said center filler means with the connection means comprising slots on said vertical plate means adapted to receive said reinforcing rib means.

5. The arrangement of claim 4 and;
   - rear lug stops;
   - said rear lug stops each having means abutting said center filler plate means;
   - said rear lug stops having gusset means aligned with the continuous reinforcing rib means of the draft lug means.

6. The arrangement of claim 1 wherein said center filler means include:
   - front and rear plates;
   - intermediate plates; and
   - means interconnecting said intermediate plates to provide a reinforced opening.

* * * * *